United States Patent [19]

King et al.

[11] Patent Number: 4,761,935

[45] Date of Patent: Aug. 9, 1988

[54] DEVICE FOR RETAINING CARTON FLAPS IN CLOSED OR OPEN POSITION

[76] Inventors: Feather W. King, 165 Reiten Dr., Ashland, Oreg. 97520; Siegfried G. V. Leibthal, 1013 Holly St., Alameda, Calif. 94501

[21] Appl. No.: 55,916

[22] Filed: Jun. 1, 1987

[51] Int. Cl.[4] ..... B65B 61/00

[52] U.S. Cl. ..... 53/416; 24/563; 53/387; 53/390; 53/138 R

[58] Field of Search ..... 53/390, 492, 381 R, 53/387, 138 R, 491, 410, 416; 24/570, 563, 30.5 S

[56] References Cited

U.S. PATENT DOCUMENTS

| | | | |
|---|---|---|---|
| 1,761,787 | 6/1930 | Gorman, Jr. | 53/416 |
| 2,801,453 | 8/1957 | Melvin | 24/570 |
| 2,867,019 | 1/1959 | Streeter et al. | 24/563 |
| 2,938,252 | 5/1960 | Scheemaeker | 24/563 X |
| 2,950,514 | 8/1960 | Small | 24/570 |
| 3,348,272 | 10/1967 | Germani | 24/563 |
| 4,528,800 | 7/1985 | Burns | 53/492 |
| 4,619,398 | 10/1986 | Laramie | 229/17 |

*Primary Examiner*—James F. Coan
*Attorney, Agent, or Firm*—Thomas M. Freiburger

[57] ABSTRACT

A holder for flaps of corrugated cartons is designed to temporarily hold carton flaps either in the fully opened position, for loading or unloading, or in a temporarily closed position. The device acts as a clip, with two flanges between which one or two layers of corrugated board may be engaged. The clip preferably is formed of one integral piece, with one flange being substantially the size of a large central opening in the other flange. The inner flange may have a rest position which extends slightly through the opening of the outer flange, so that the clip always tends to spring back to this position and will exert a clamping force on the carton flaps.

11 Claims, 1 Drawing Sheet

DEVICE FOR RETAINING CARTON FLAPS IN CLOSED OR OPEN POSITION

BACKGROUND OF THE INVENTION

The invention relates to carton flap holding devices, and in particular it relates a temporary holder or clip for retaining carton flaps either in the closed position or the fully open position.

A number of different devices have been suggested for retaining flaps of various types of cartons in an opened or a closed position. For example, see U.S. Pat. Nos. 2,801,453, 4,528,800 and 4,619,398. The latter patent discloses a closer and sealer device for sliding onto the top of a milk carton in order to hold and seal the previously opened carton flaps in the closed position.

U.S. Pat. Nos. 2,801,453 and 4,528,800 both disclose carton flap holders for a purpose which is similar to one function of the present invention: holding the flaps of a corrugated carton in the fully opened position, as for loading or unloading. The devices of the patents comprise three projecting parallel prongs, spaced apart from each other and all integral with a connecting spine portion at one end. The devices were intended to be pushed down on the corner of a carton with the flaps open and folded back, with the central prong inside the corner of the carton and the two outer prongs on the outside, engaging the surfaces of the side flap and the end flap.

The described devices were configured differently from the flap holder of the present invention, and neither had the versatility of use of the present invention as described below.

SUMMARY OF THE INVENTION

The carton flap holder of the present invention is simple in construction, and is capable of retaining the flaps of an ordinary corrugated carton in either the closed or the fully opened position. The clip-like flap holder is usable with a wide range of thicknesses of corrugated board or other types of cartons.

The carton flap holder of the invention comprises a clip-like structure, with a pair of flat flanges or tabs connected together at one end by a connector or bight portion, and preferably formed integrally of one piece. For springing engagement against one or two thicknesses of the carton material, the flap holder device includes a means for biasing one flap-holding flange member toward the other.

For temporarily holding carton flaps closed, the device of the invention is engaged over the edges of the closed major flaps, one flap holder at each end of the carton. The flap holder is pushed onto the major flaps from the carton end, so as to straddle the gap between the two major flaps. One flapholding flange goes on the outside of the carton, engaging the two major flaps from above, while the other flange extends just under the major flaps, engaging them from below, between the major flaps and the minor flap.

For holding the flaps of a carton in the fully opened position, the flap holder device is engaged downwardly over the folded area at the juncture of the flap and the carton wall, with one flange on the outside of the flap and the other flange inside the carton, against the carton wall. The flanges must be spread apart somewhat against the biasing force to do this. Four of the flap holders may be used on a carton to hold all flaps in the open position.

The biasing force tending to draw the two flanges of the flap holder together will tightly engage the single thickness of two adjacent major flaps, when holding carton flaps closed, as well as accommodating the two thicknesses of a flap and a sidewall, when holding the flaps in the open position.

The connector or bight of the flap holder preferably is somewhat extended in a plane generally perpendicular to the two flap-holding flanges. It is configured to extend downwardly a short distance, which may be about one-half inch, when the flap holder is used to hold carton flaps closed as described above. Thus, the extended bight portion engages the wall of the carton and provides a positive stop, when the flap holder is pushed into position in this type of use. It also provides a flat area of adequate size for positioning an identifying label or for color-coding.

In a preferred embodiment, the flap holder of the invention may have one flange or panel which is larger than the other flange, with a large central opening through which the smaller flange can extend slightly in the rest position of the flap holder. The smaller flange must be pushed outwardly, through the opening, to spread the two flanges when the flap holder is to be engaged on a carton.

It is therefore among the objects of the invention to provide a versatile carton holder device which is easy to use, inexpensive to manufacture, and which is capable of holding carton flaps either in a fully opened or closed position. These and other objects, advantages, features and characteristics of the invention will be apparent from the following description of a preferred embodiment, considered along with the accompanying drawings.

DESCRIPTION OF PREFERRED EMBODIMENT

Figure 1:
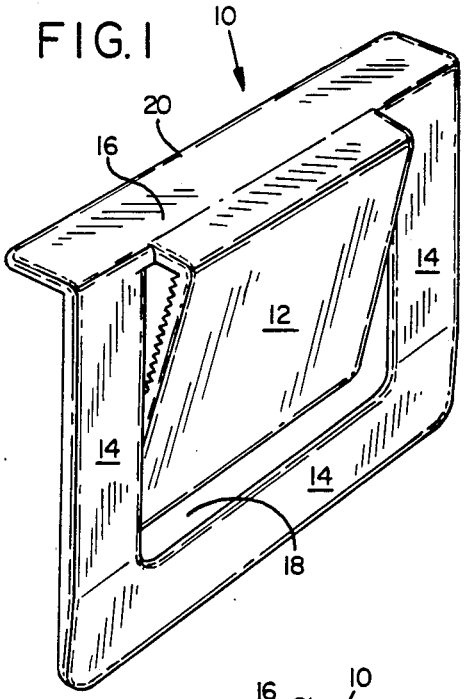
FIG. 1 is a perspective view of a carton flap holder according to a preferred embodiment of the invention.
Figure 2:
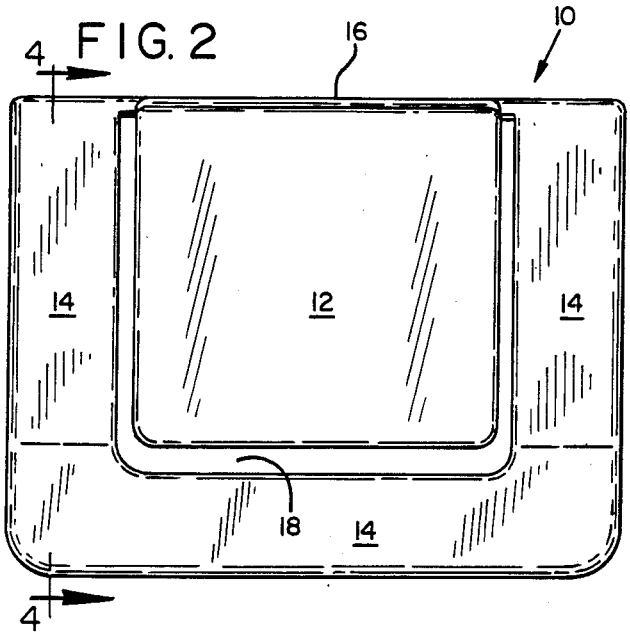
FIG. 2 is a front elevation or plan view of the carton flap holder.

In the drawings, FIG. 1 shows a carton flap holder device 10 according to a preferred embodiment of the present invention. The carton flap holder 10 includes a first or smaller tab flange 12 and a second, larger tab or flange 14. The two flanges 12 and 14 are connected together at one end by a connector or bight portion 16, the entire flap holder 10 preferably being integrally formed from one piece of material. The material may be a relatively rigid plastic material such as polyethylene or polypropylene, or it may be a metal. In any event, the material should permit some bending, with substantially elastic properties within the range of bending in order to return it to its relaxed position as shown in FIG. 1.

As FIG. 1 illustrates, the first flange 12 of the clip 10 is biased toward the second flange 14, in order to exert a clamping pressure on one or two thicknesses of carton material when the device is used. In the preferred embodiment shown in the drawings, the smaller, inner flange or tab 12 actually protrudes through a large central opening 18 in the larger tab 14, in the rest position shown in FIGS. 1 through 4. This gives the device 10 a significant springing force, toward the rest position, when the flanges 12 and 14 are spread apart for use.

Figure 3:
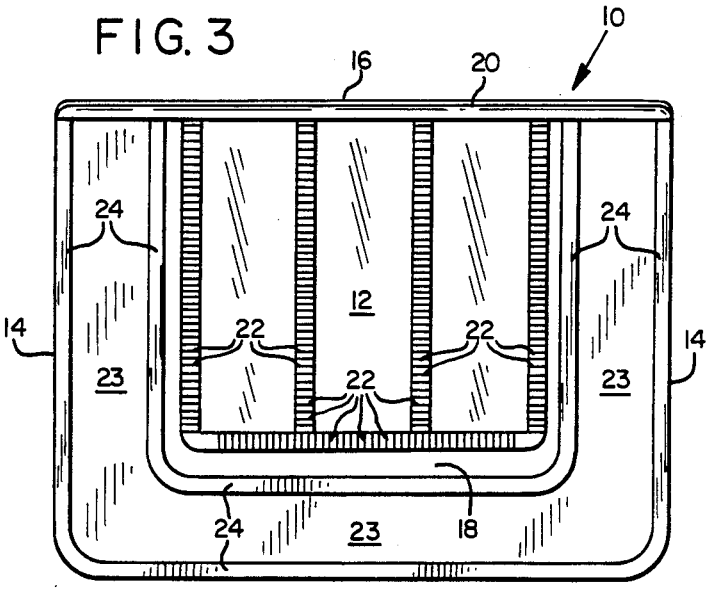
FIG. 3 is a rear elevation or bottom plan view of the flap holder, showing ribs on an inner flange for engaging a carton.

As shown in FIGS. 1 and 3, the connector or bight portion 16 of the flap holder 10 may have an extended lip 20, lying generally in a plane perpendicular to the two flanges 12 and 14. The lip 20 serves two functions—first, it provides a positive stop, when the flap holder device is engaged on a carton (see in particular FIG. 5); and second, it provides a surface of sufficient area for applying a label or for color coding the lip to indicate something about the particular box or its contents or status.

As also shown in the drawings, particularly FIGS. 1 and 3, the bight portion 16 preferably has an extension 21 where it adjoins the smaller tab or panel 12, providing spacing between the two tabs 12 and 14 to accommodate one or two thicknesses of corrugated or other carton material.

Figure 4:
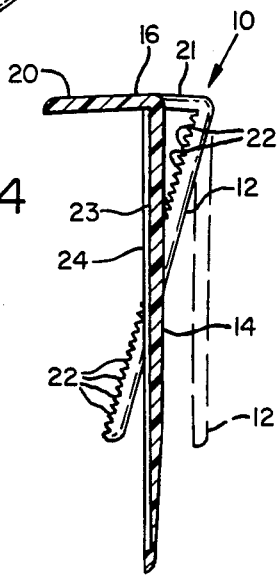
FIG. 4 is a side elevation view of the device, partially in section.

FIGS. 3 and 4 show a multiplicity of ribs 22 which may be formed on the back surface of the inner panel or flange 12. These may be arranged as shown in FIG. 3, in vertical rows and also horizontally along the bottom of the panel 1. The ribs grip carton flaps or walls to help prevent slippage.

As also shown in FIGS. 3 and 4, the back side of the larger panel or flange 14 may in the preferred embodiment include a recessed area 23, with thicker structural ridges 24 at each border of the panel 14 to impart strength.

Figure 6:
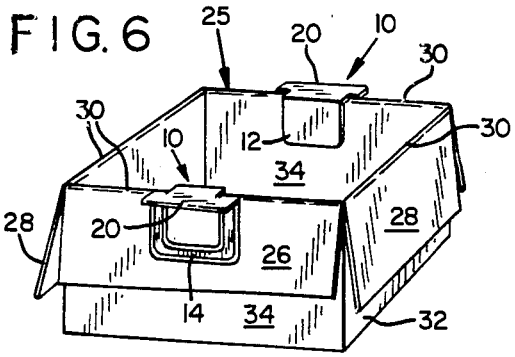
FIG. 6 is a perspective view showing several of the carton flap holders of the invention engaged on a carton so as to hold the carton flaps in a fully opened position.
Figure 5:
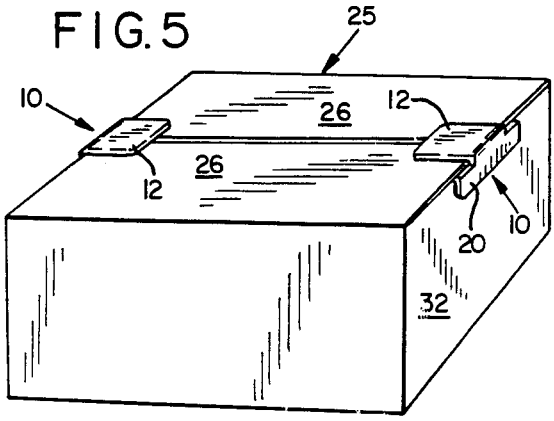
FIG. 5 is a perspective view showing a use of the carton flap holder wherein the major flaps of a carton are engaged in the closed position, to temporarily hold the carton closed.

FIG. 5 shows the clip or carton flap holder device 10 engaged on a closed carton 25. The flap holder 10 is inserted over the edges of the closed major flaps 26 as shown, with the smaller flange 12 on the outside (on top), straddling the gap between the flaps 26 and engaging the outside surfaces of both flaps. The ribs 22 (FIG. 3) help grip both flaps. The larger flange 14 of the holder device is not seen in FIG. 5, but is between the major flaps 26 and the minor flaps 28. As illustrated, the extended lip 20 of the flap holder engages against the end wall 32 of the carton, providing a rigid stop and also an adequate area for labeling or color coding. The smaller flange 12 can also be used for labeling or color coding, being readily visible on the top of the carton. It can also be used in this way for the application shown in FIG. 6.

FIG. 4 shows the carton flap holder 10 of the invention as used to retain carton flaps 26 and 28 in the fully opened and folded back position. The inner or smaller tab 12 is first pushed out of the opening 18 of the larger flange or tab 14, so that the flanges are spread apart somewhat, and the flap holder 10 is then engaged down over the fold 30 at the juncture of the flap and the carton wall 34. Either flange may be on the outside in this manner of use of the invention, but preferably the smaller flange 14 is on the inside, against the carton wall 34 as shown, so that the lip 20 does not obstruct loading and unloading.

Four of the flap holders 10 may be used in the manner illustrated, to hold the four flaps of a carton in a fully opened position for loading, unloading, or displaying.

The configuration of the flap holder device shown in the drawings is particularly adaptable to injection molding. It is simple yet effective in engaging the flaps of a carton, in one or two thicknesses, with adequate gripping force.

The preferred embodiment described herein is intended to illustrate the principles of the invention, but not to be limiting of the scope of the invention. Various other embodiments and variations to this emodiment will be apparent to those skilled in the art and may be made without departing from the scope of the invention as defined in the following claims.

We claim:

1. A method for holding a flap of a carton in a fully opened and folded back position, comprising, providing a clip-like holding device comprising two generally parallel and generally planar flanges connected at one end, with biasing means for urging the flanges toward convergence, and with the flap holding device so configured as to be capable of receiving a double thickness of carton material between the two flanges when the flanges are spread apart, manually spreading the two flanges apart against the force of the biasing means, sufficiently to engage the flap holding device as a clip over a double thickness of the carton material, slipping the device down over a fold at the juncture of a flap and a side wall of the carton, so that one flange is engaged against the outside of the flap and the other flange is engaged against the inside surface of the carton wall, and repeating the same procedure with another flap holding device, for each flap of the carton which is desired to be held in the open position, and further including removing the flap holding devices and closing the flaps of the carton when desired, and temporarily holding the carton in the closed configuration by engaging two of the flap holding devices over the ends of the major flaps of the carton, the major flaps being on the exterior, by spreading the flanges of each flap holding device apart and sliding the device inwardly from the end of the carton, straddling the two major flaps such that the major flaps are engaged by one flange at their top side and by the other flange at their bottom side.

2. A method for temporarily holding a carton in a closed configuration, with minor and major flaps of the carton folded inwardly, and the major flaps on the exterior at the top of the carton, comprising the steps of:

providing a clip-like flap holding device comprising two generally parallel and planar flanges connected together at one end at a bight portion, and with biasing means urging the two flanges toward convergence, manually spreading the flanges apart against the force of the biasing means, sufficiently to engage the device as a clip over a single thickness of a carton flap, from one end of the carton, sliding the flap holding device horizontally inwardly, with the flanges spread open, so as to engage the flanges at upper and lower sides of the major flaps, straddling a gap between the flaps, whereby the major flaps at their edges are engaged flatly between the planes of the two flanges, urged by the biasing means so that the two major flaps tend to stay in a common plane and thus in a closed position, and similarly sliding a second flap holding device onto the edges of the major flaps at the opposite side of the carton.

3. A carton flap holding device for clipping onto a carton to hold flaps in a fully opened position or a closed position, comprising, a pair of flap engaging flanges, each generally planar and generally parallel to one another, a bight portion at one end of the flanges, connecting the two flanges together, and including biasing means urging the flanges toward one another so as to enable the two flanges to clamp flat articles of varying thicknesses between them, and the bight portion including a flat planar area generally perpendicular to the two flanges.

4. The carton flap holding device of claim 3, wherein the two flanges comprise a larger flange in a frame-like shape with a large central opening, and a smaller flange in the form of a panel generally the size of the opening in the larger flange, and positioned adjacent to the opening, the two flanges being connected together at the bight portion and the holding device being integrally formed of one piece of material.

5. The carton flap holding device of claim 4, wherein the central opening in the larger flange, and the panel forming the smaller flange, are generally rectangular in shape.

6. The carton flap holding device of claim 4, wherein the smaller flange or panel includes a generally right-angled portion at said one end, arranged generally as an extension of the bight portion, such that at said one end the panel is spaced outwardly from the larger flange, and the planes of the two flanges are spaced apart at said one end sufficiently to receive two thicknesses of the carton material.

7. The carton flap holding device of claim 6, wherein, in a normal rest position, the smaller flange or panel extends back through the central opening of the larger flange somewhat, serving as said biasing means, so that manual pressure is required to push the smaller flange out of the opening of the larger flange and into a position where the panel and the larger flange are separated at the end opposite said one end, sufficiently to be engaged over one or two thicknesses of the carton material and clamped thereon.

8. The carton flap holding device of claim 3, wherein the flat planar area is of sufficient size to receive a label.

9. The carton flap holding device of claim 3, wherein one of the flanges includes series of raised carton-engaging ribs in position to engage and grip a carton when the device is engaged on a carton.

10. The carton flap holding device of claim 3, wherein the device is integrally molded from one piece of material.

11. The carton flap holding device of claim 10, formed of relatively rigid plastic material.

* * * * *